United States Patent [19]

Hult et al.

[11] Patent Number: 4,888,849

[45] Date of Patent: Dec. 26, 1989

[54] WHEELED HAND CART FOR WET/DRY UTILITY VACUUM CLEANER

[75] Inventors: David R. Hult; Jeffrey L. Young, both of St. Peters, Mo.

[73] Assignee: Emerson Electric Co., St. Louis, Mo.

[21] Appl. No.: 242,866

[22] Filed: Sep. 12, 1988

[51] Int. Cl.[4] ..... A47L 9/00

[52] U.S. Cl. ..... 15/327 F; 15/353; 15/410; 280/47.26

[58] Field of Search ..... 280/47.26, 47.27, 654; 15/327 F, 327 D, 353, 410

[56] References Cited

U.S. PATENT DOCUMENTS

| | | | |
|---|---|---|---|
| 2,819,485 | 1/1958 | Sparklin | 15/410 X |
| 2,876,484 | 3/1959 | Wells | 15/410 X |
| 2,950,925 | 8/1960 | Larson | 280/47.26 X |
| 3,063,082 | 11/1962 | Rosenberg | 15/328 X |
| 3,358,316 | 12/1967 | Okun | 15/327 D X |
| 4,222,145 | 9/1980 | Lowder | 280/47.26 X |

*Primary Examiner*—Chris K. Moore

*Attorney, Agent, or Firm*—Polster, Polster and Lucchesi

[57] ABSTRACT

A wheeled hand cart for use with a wet/dry utility vacuum cleaner drum is disclosed. A pair of wheel frames are mounted to the drum in spaced relationship to each other along a lower outer periphery of the drum. Each wheel frame has a horizontally extending passageway and a vertically extending channel that intersects and extends across each horizontally extending passageway. An upright handle section is positioned within the vertically extending channel of each wheel frame and has a transverse opening which is in alignment with the horizontally extending passageway of each wheel frame. Horizontally extending passageways of the spaced wheel frames are in alignment with one another to receive a wheel axle extending therethrough and also through the transverse openings of the upright handle sections. The wheels are mounted on the wheel axle for wheeled movement of the hand cart. A handle interconnects the upright handle sections to facilitate movement of the drum by the wheeled hand cart. The interconnecting handle and upright handle sections are also associated relative to the drum and an overlying drum cover in order to provide a stable and secure mounting of the wheeled hand cart relative to the drum.

17 Claims, 5 Drawing Sheets

WHEELED HAND CART FOR WET/DRY UTILITY VACUUM CLEANER

BACKGROUND OF THE INVENTION

The present invention relates to a wheeled hand cart for a wet/dry utility vacuum cleaner, and more particularly, to a wheeled hand cart mounted to the hollow drum of a wet/dry utility vacuum cleaner for movement and re-positioning of the wet/dry utility vacuum cleaner, as desired.

Prior art shop-type utility vacuum cleaners are generally constructed as semi-stationary drum-type units in which the vacuum cleaner contains its own power source mounted on the top of the drum-type unit. A vacuum hose is connected to the power source for generating a partial vacuum in the hose to collect debris within the vacuum cleaner drum. Typically, such units are both wet/dry debris collecting units, and as can be expected, the drum, is quite heavy when filled. Caster wheels with brakes are provided to allow the drum-type units to be moved and re-positioned at various locations, where the caster wheel brake can be set for operation of the vacuum cleaner.

In addition to caster wheels for moving the drum-type units to various locations, wheeled hand carts have also been developed for moving the wet/dry utility drum-type vacuum cleaners. In general, prior art wheeled hand carts are similar to hand trucks used for moving boxes, furniture, etc., although they are specifically constructed and adapted to fit drum-type units. Such prior art wheeled hand carts enable the drum-type units to be tilted for moving the drum-type units on wheels larger than the caster wheels. While these specially constructed wheeled hand carts have worked well for their intended purpose, they unnecessarily have required a large number of parts which obviously affects the manufacture, assembly and cost of such wheeled hand carts. In one specific wheeled hand cart device, 116 parts are used to construct and assemble the wheeled hand cart relative to a wet/dry utility drum-type vacuum cleaner unit. This suggests that a substantial opportunity exists to provide a new and improved wheeled hand cart for wet/dry utility drum-type vacuum cleaners which overcomes the aforenoted deficiencies of prior art wheeled hand carts for wet/dry utility vacuum cleaner drum-type units.

SUMMARY OF THE INVENTION

Among the several objects and advantages of the present invention include:

The provision of a new and improved wheeled hand cart or truck for wet/dry utility drum-type vacuum cleaner units;

The provision of the aforementioned wheeled hand cart for wet/dry utility drum-type vacuum cleaner units which enables several of the components to perform multiple-functions/uses to minimize the number of parts required;

The provision of the aforementioned wheeled hand cart which utilizes a wheel frame mounted to the drum-type unit for receiving a vertically extending handle section and wheel axle which extends through and is associated relative to the wheel frame;

The provision of the aforementioned wheeled hand cart that utilizes an interconnecting handle bracket to facilitate assembly of upright handle section and an interconnecting handle relative to one another, and for mounting and securing the handle assembly relative to the drum-type unit for a stable and secure mounting of the wheeled hand cart relative to the drum-type unit;

The provision of the aforementioned wheeled hand cart for wet/dry utility vacuum cleaner drum-type units which is configured, arranged and dimensioned to utilize a minimum number of parts, is economical and inexpensive to manufacture, is simple to assemble and use, is strong and durable in construction and operation, and is otherwise well adapted for the intended purposes.

Briefly stated, the wheeled hand cart of the present invention is used in connection with a wet/dry utility vacuum cleaner drum and includes a pair of wheel frames mounted to the drum in spaced relationship to one another along a lower outer periphery of the drum. Each wheel frame has a horizontally extending passageway which is in corresponding aligned relationship to the other. The wheel frames further each have a vertically extending channel that intersects and extends across the respective associated horizontally extending passageway in each wheel frame. An upright handle section is positioned within the vertically extending channel of each caster wheel frame and includes a transverse opening for alignment with the horizontally extending passageway of each wheel frame. A wheel axle extends through the horizontally extending passageways of both wheel frames, including through the transverse openings in the upright handle sections. Wheels are mounted on opposite ends of the wheel axle for wheeled movement of the hand cart. An interconnecting handle is provided for interconnecting the upright handle sections to facilitate movement of the vacuum cleaner drum by the wheeled hand cart.

A handle bracket is complementary shaped relative to the drum and extends between the upright handle sections and an interconnecting handle, through openings provided in the handle bracket, with the connecting handle and upright handle section being telescopically associated relative to one another. The upright handle sections each have a generally vertically extending flange which is generally horizontally aligned relative to the complementary shaped handle bracket and suitably configured and dimensioned to engage an overhanging depending lip of an associated drum and drum cover which overlies an upper end of the drum. The wheel frames, when attached to the drum, include a first radially inwardly extending portion and a second portion angularly offset from the first portion and generally in mirror image relationship with the second portion of the other wheel frame. The second portion of said wheel frames contain the horizontally extending passageway and intersecting vertically extending channel.

Other and further objects and advantages of the present invention will become apparent from the ensuing description.

BRIEF DESCRIPTION OF THE DRAWINGS

In the drawings.

Corresponding reference numerals will be used throughout the various figures of the drawings.

DESCRIPTION OF THE PREFERRED EMBODIMENTS

Figure 1:
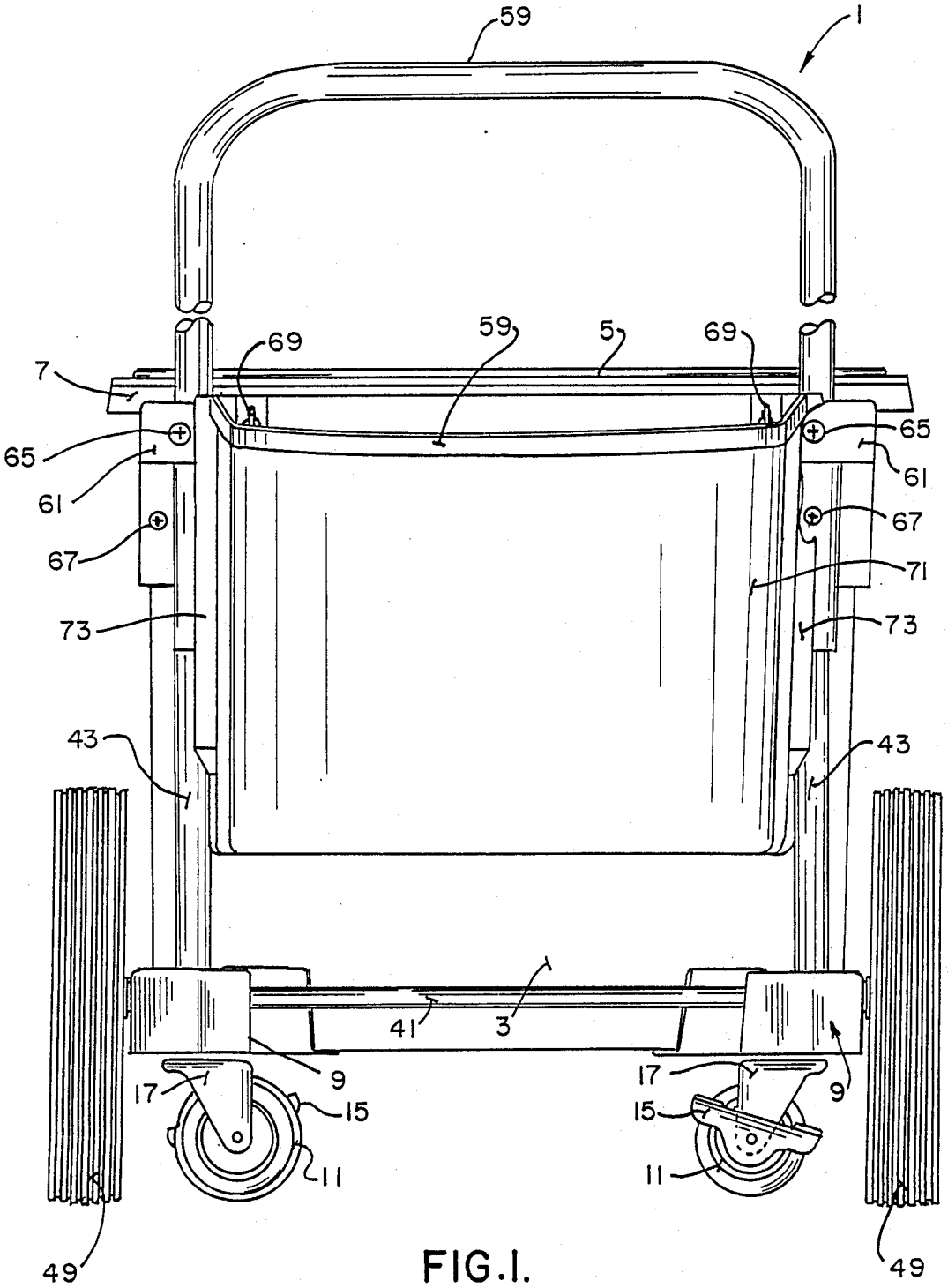
FIG. 1 is a front elevational view of a wheeled hand cart, constructed in accordance with with the teachings of the present invention, assembled relative to a wet/dry utility vacuum cleaner drum unit.

As best seen in FIG. 1 of the drawings, the wheeled hand cart 1 of the present invention is constructed for use in conjunction with a wet/dry utility vacuum cleaner drum 3 having a drum cover 5, overlying the open upper end of the drum 3, and having a circumferentially extending and depending flange 7 of the drum cover 5 spaced from the outer peripheral wall of the drum 3, in a typical manner. In the usual setting, a power source (not shown) is mounted atop of the drum cover 5 and is connected to the drum or drum cover 3, 5 for collecting dry or wet debris through, a vacuum cleaner hose (not shown) associated with the power source, as will be understood. The wheeled hand cart 1 of the present invention may be used with any one of a variety of wet/dry utility vacuum cleaners.

Figure 2:
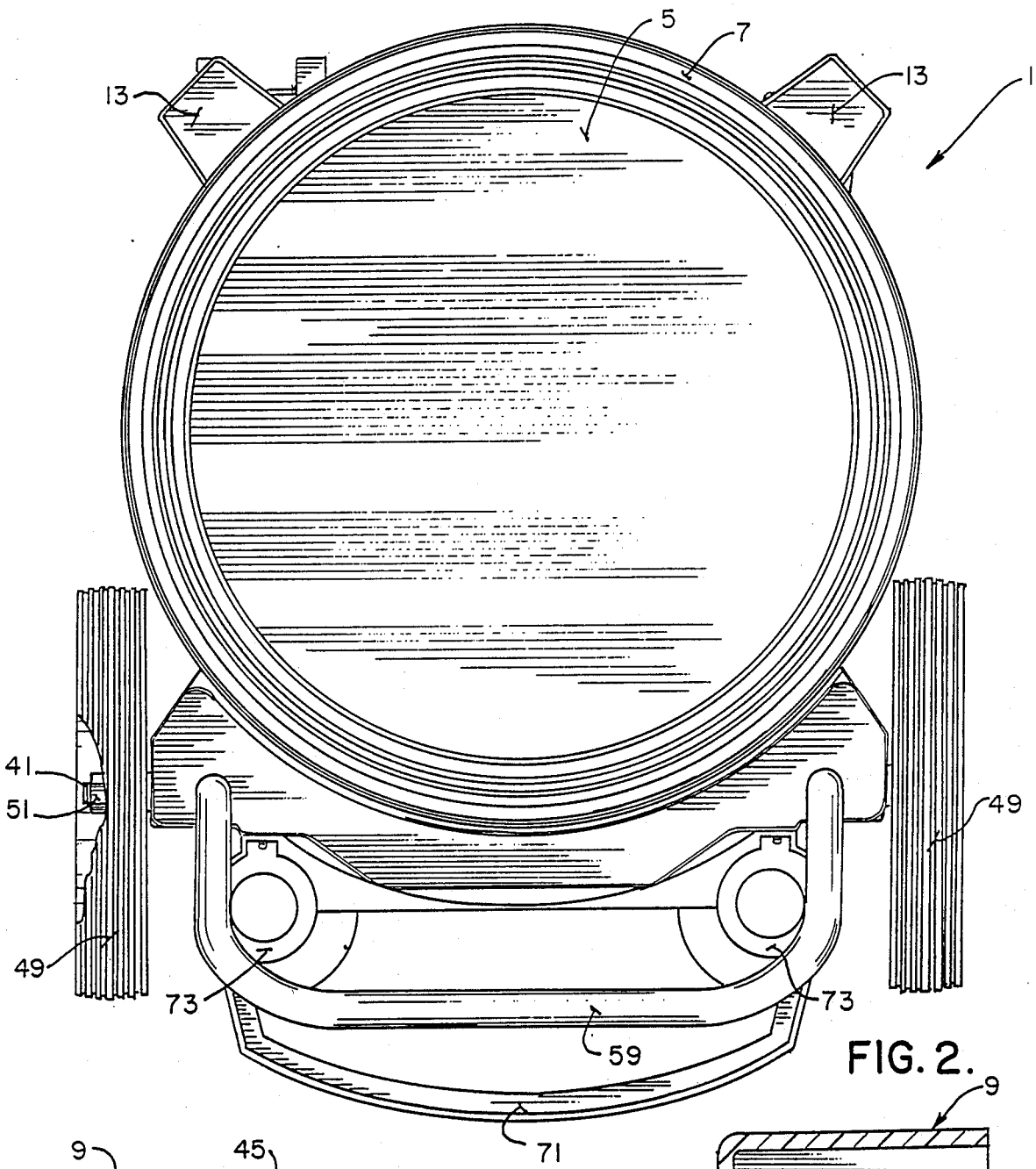
FIG. 2 is a top plan view of the assembled wheeled hand cart and wet/dry utility vacuum cleaner drum as shown in FIG. 1.
Figure 3:
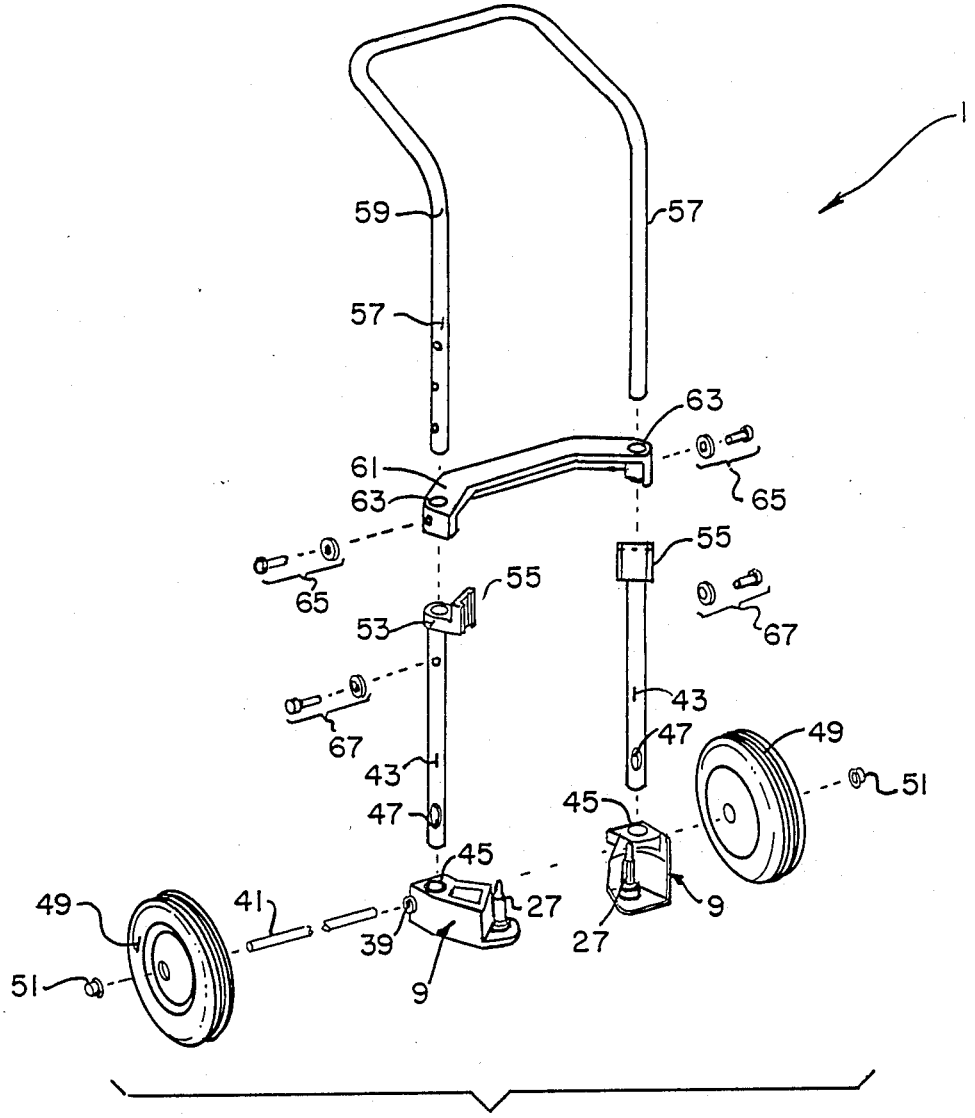
FIG. 3 is an isometric exploded view of the various components forming the wheeled hand cart of the present invention.

As best seen in FIGS. 1–3 of the drawings, the wheeled hand cart 1 includes a pair of spaced wheel frames 9, 9 which are mounted to the drum 3 in spaced relationship to each other along the lower periphery of the drum 3. The wheel frames 9, 9 are constructed to mount and receive the large wheels 49, 49 about the outer periphery of the drum 3 along one side thereof, as best seen in FIG. 1. In FIG. 2 of the drawings, a spaced pair of caster wheel frames 13, 13 containing caster wheels 11, 11 provide spaced pairs of caster wheels on the other side of the drum 3.

Each of the caster wheels 11, 11, associated with the spaced caster wheel frame 13, 13 are provided with caster wheel brakes 15, 15 of conventional construction which are pivotally mounted to the U-shaped cradles 17, 17 along the axis of the caster wheels 11, 11 In the usual caster wheel construction, a stud or stem extends upwardly from the cradles 17, 17 for complementary reception within an opening or aperture of the caster wheel frames 13, 13. Reference is now made to FIGS. 4–8 of the drawings for a description of the wheel frames 9, 9 used in the wheeled hand cart 1 of the present invention. When mounted to the drum 3, each wheel frame 9 includes a first radially inwardly directed portion 23 and an integral second portion 25 angularly offset relative to the first portion 23 and in generally mirror image relationship with the corresponding second portion 25 of the other wheel frame 9, for purposes to become apparent. At one end of the first portion 23 of the wheel frame 9 is a upwardly extending male post 27 having a series of circumferentially spaced ribs 29 along the outer periphery thereof for deformable and interfering engagement with an opening (not shown) in the bottom wall of the drum 3. The male post 27 is arranged relative to a curvilinear wall 31 of the first portion 23 so as to permit the outer peripheral wall of the drum 3 to be engaged by the curvilinear wall 31 when the male post 27 is correspondingly received within the opening in the bottom wall of the drum 3. At the same time, the horizontal underlying supporting surface 28 is constructed to engage the bottom of the drum 3. In this way, the wheel frame 9 is stably securely mounted relative to the drum 3.

Figure 7:
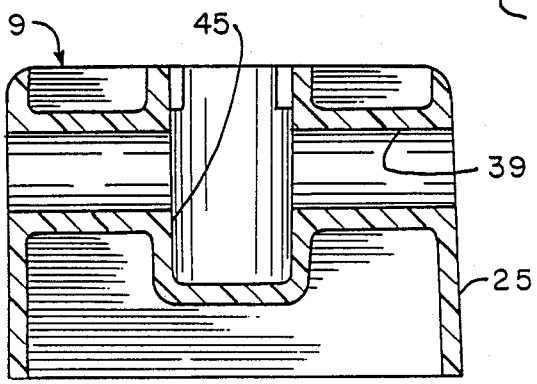
FIG. 7 is a vertical sectional view taken along Lines 7–7 of FIG. 4.
Figure 8:
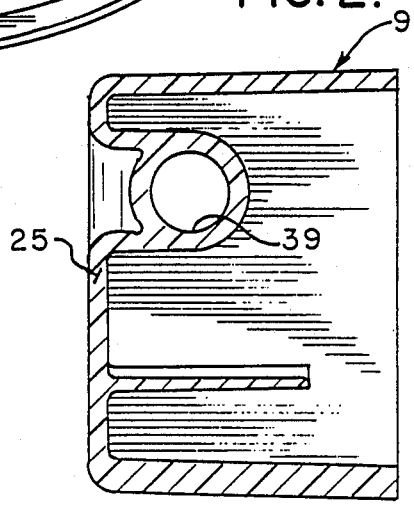
FIG. 8 is a vertical sectional view as viewed along lines 8–8 of FIG. 4.
Figure 6:
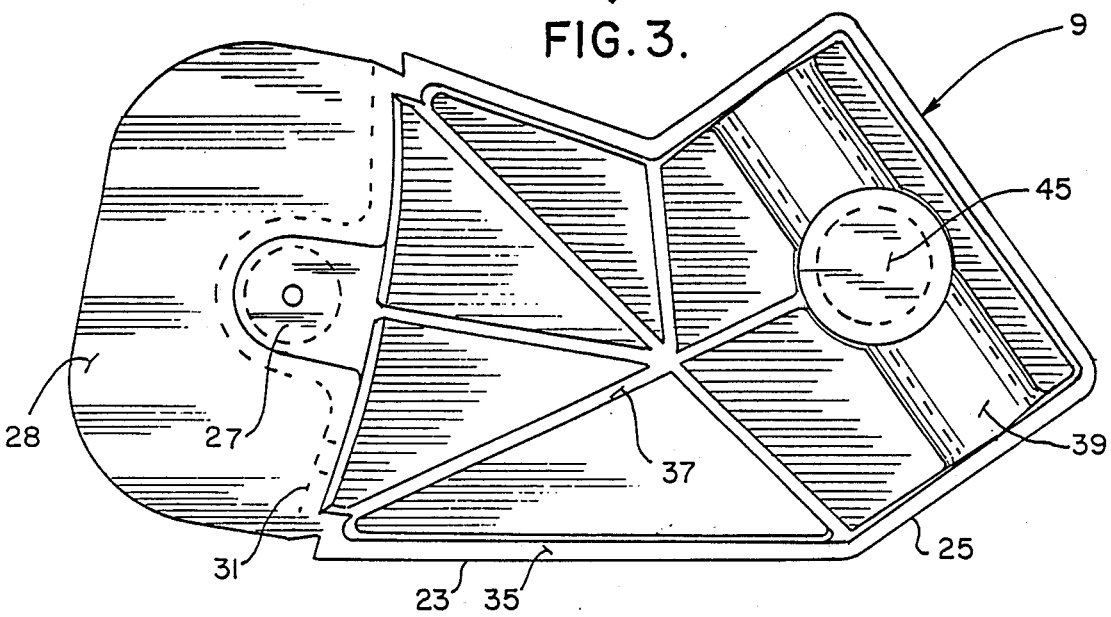
FIG. 6 is a bottom plan view of the wheel frame illustrated in FIGS. 4–5.
Figure 4:
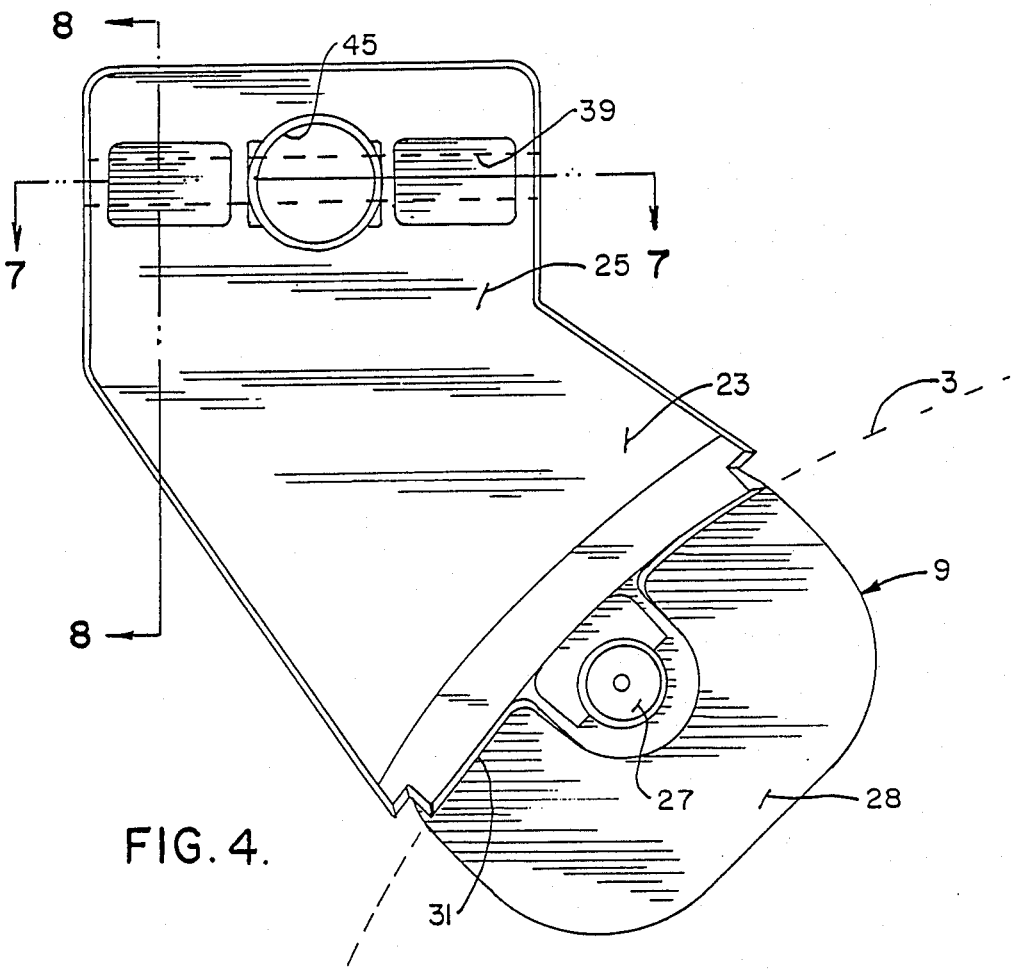
FIG. 4 is a top plan view of one of the wheel frames utilized in the wheeled hand cart of the present invention.
Figure 5:
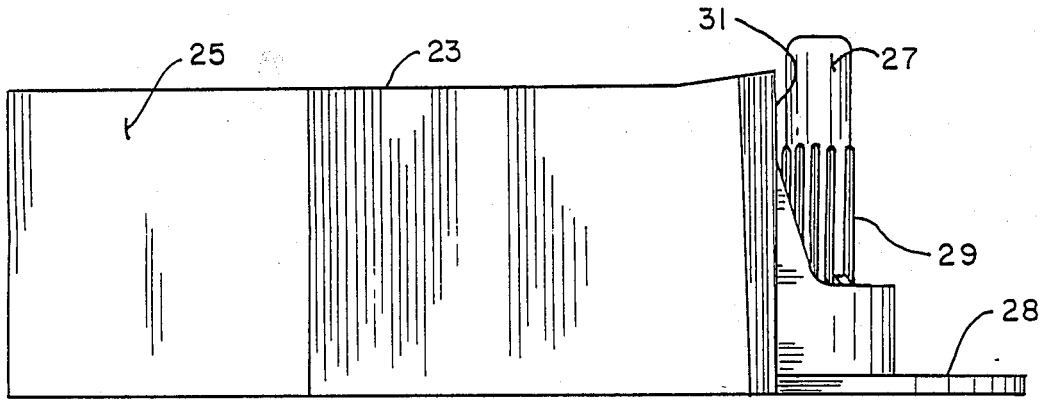
FIG. 5 is front elevational view of the wheel frame shown in FIG. 4.
Figure 9:
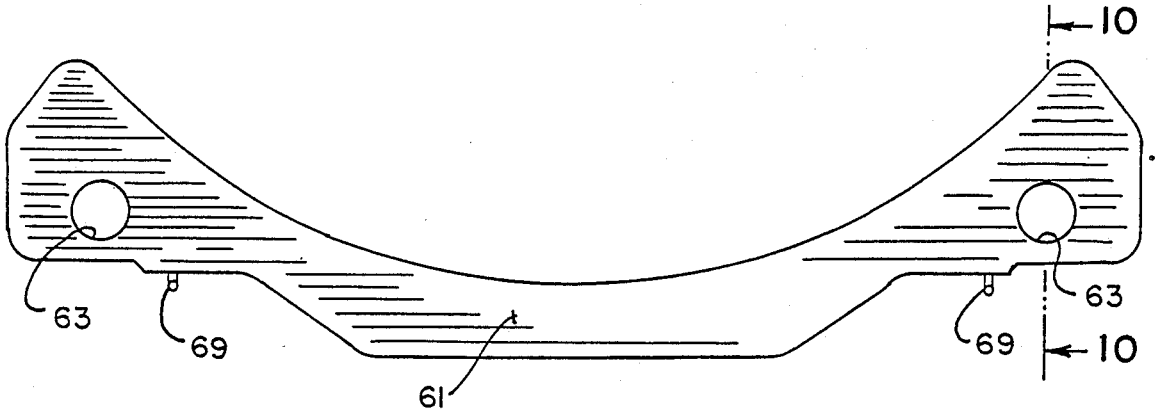
FIG. 9 is a top plan view of the complementary shaped handle bracket component utilized in the wheeled hand cart of the present invention.

As best seen in FIGS. 5–6 of the drawings, the first integral portion 23 of the wheel frame 9 includes a hollow interior 33 with a series of integral intersecting rigid vanes or fins 37 that extend between the first and second integral portions 23, 25 of each wheel frame 9 as shown in FIG. 6 of the drawings. The integrally connected and angularly offset second portion 25 of each caster wheel frame 9 includes a horizontally extending passageway 39 which extends completely therethrough, as best seen in FIG. 7 of the drawings. As explained above, the second portions 25 of the spaced caster wheel frames 9, 9 are in generally co-planar relationship, in order to enable horizontally extending passageways 39, 39 of each wheel frame 9, 9, to be in corresponding aligned relationship to one another. This enables a wheel axle 41 to extend through the horizontally extending passageways 39, 39 of both wheel frames 9, 9.

However, before the wheel axle 41 is inserted through the corresponding aligned horizontally extending passageways 39, 39, an upright handle section 43 is mounted within a vertically extending channel 45 which intersects and extends across each of the horizontally extending passageways 39, as seen in FIG. 7 of the drawings. The lower end of each tubular upright handle section 43 contains a transverse opening 47 therein in order to enable the wheel axle 41, when inserted into the horizontally extending passageway 39 to extend through and hold the upright tubular handle section 43 within each wheel frame 9, as will now be apparent. When the wheel axle 41 is inserted into each of the horizontally extending passageways of the wheel frames 9, including through the transverse openings 47 of the upright tubular handle section 43, exposed ends of the wheel axle 41 will enable wheels 49, 49 to be mounted at opposite ends thereof. The wheels 49, 49 may be held in place by a suitable fastener 51, as is customary.

At the upper end of each hollow upright tubular section 43 is an integrally molded collar 53 with generally vertically directed flange 55 that extends at right angles thereto. The collar 53 extends around the upright tubular section 43 in order to allow the free ends 57, 57 of an interconnecting U-shaped handle 59 to be telescopically assembled within the hollow upright tubular handle sections 43, 43 that extend upwardly from each of the wheel frames 9, 9. An integrally molded bracket element 61, generally complementary shaped relative to the outer configuration of the drum 3, includes vertical openings 63, 63 at opposite ends thereof for receiving the free ends 57, 57, of the interconnecting handle 59 prior to being telescopically associated relative to the hollow upright tubular sections 43, 43. Suitable fasteners (including stud and washer) 65, 67 for the bracket 61 and tubular upright section 43, engage the free ends 57, 57 of the interconnecting handle 59 at various selective positions, based on the desired height thereof.

Figure 10:
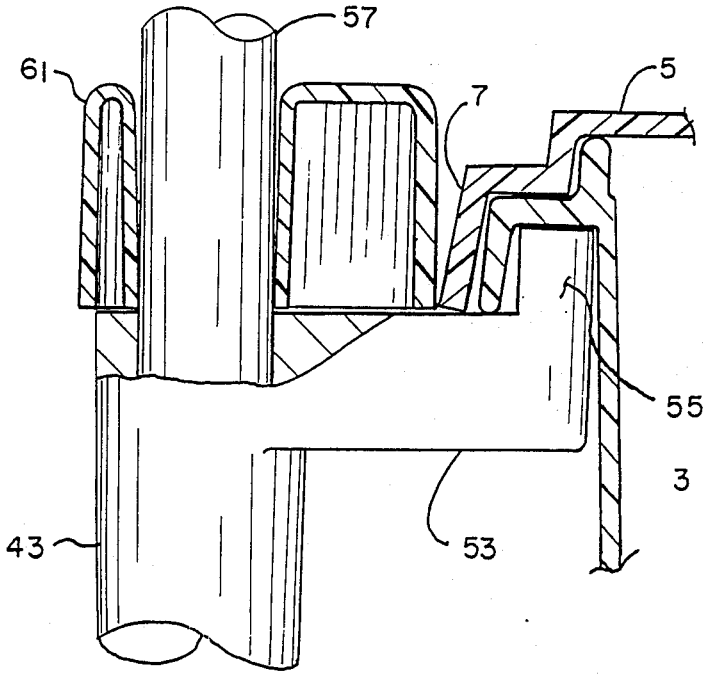
FIG. 10 is a fragmentary vertical sectional view illustrating the manner in which the drum and associated drum cover of the wet/dry utility vacuum cleaner drum are engaged relative to the interconnecting handle assembly of the wheeled hand cart of the present invention.

When the interconnecting handle 59 is assembled through the apertures 63 of the bracket 61 and then telescopically assembled relative to the upright tubular sections 43 through the collar 53, it will be noted in FIG. 10 of the drawings that the generally vertically direct flange 55 is constructed to engage the outer peripheral wall of the drum 3 and the associated depending overhanging lip 7 of the drum cover 5 and outer depending flange of drum 3. Thus, the generally upwardly directed flange 55, in addition to engaging the outer peripheral wall of the drum 3, may be utilized to trap the depending overhanging lip 7 of the drum cover and associated depending flange of the drum 3 between the generally vertically direct flange 55 and the bracket 61, as shown in FIG. 10. This provides an upper inner engagement between the wheeled hand cart 1 and the drum and drum cover 3, 5 respectively, while the wheel frame 9, through the male post 27, the underlying horizontal supporting surface 28 and curvilinear wall surface 31 provides a lower stable and secure mounting of the wheel hand cart 1 relative to the associated drum 3.

The wheeled hand cart 1 may be provided with suitable accessories, as desired. For example, the integrally molded handle bracket 61 may be provided with spaced hook portions 69, 69 for detachably mounting an accessory container 71 immediately below the upwardly and outwardly extending U-shaped interconnecting handle 59, as shown in FIGS. 1–2 of the drawings. Additionally, hollow tubular extension holders 73, 73, for receiving vacuum hose tubular extensions (not shown), may be attached to the drum 3 or mounted to the handle bracket 61, as may be desired.

From the foregoing, it will be appreciated that the wheeled hand cart of the present invention is constructed for use in conjunction with a wet/dry utility vacuum cleaner and utilizes components having multiple functions/uses that minimize the number of parts required, and thus reduce the cost of manufacturing, assembly and ultimate cost of the wheeled hand carts. According to the present invention, only 23 individual parts, including metal, molded and fastening elements, are required, as compared with prior art designs which have required up to 116 individual parts.

In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. A wheeled hand cart for use with an appliance such as a drum or the like, comprising:

a pair of wheel frames mounted to said drum in spaced relationship to each other along a lower outer periphery of the drum, each wheel frame having a horizontally extending passageway which is in corresponding aligned relationship the other, said wheel frames further each having a vertically extending channel that intersects and extends across the respective associated horizontally extending passageway in each wheel frame;

an upright handle section positioned within the vertically extending channel of each wheel frame and having a transverse opening therein for alignment with the horizontally extending passageway of each wheel frame;

a wheel axle extending through the horizontally extending passageways of both wheel frames including through the transverse openings in said upright handle sections;

wheels ;mounted on opposite ends of said wheel axle for wheeled movement of said hand cart; and a handle interconnecting said upright handle sections to facilitate movement of said drum by said wheeled hand cart.

2. The hand cart as defined in claim 1 wherein each wheel frame includes an upwardly extending male post for complementary association relative to a corresponding bottom opening in said drum for mounting said wheel frames to said drum.

3. The hand cart as defined in claim 2 wherein the horizontally extending passageway and intersecting vertically extending channel are provided adjacent one end of each wheel frame, and said upwardly extending male post is provided at the other end of said wheel frame.

4. The hand cart as defined in claim 3 wherein each wheel frame includes a first radially inwardly extending portion, when attached to said drum, including said upwardly extending male post, and an integral second portion angularly offset relative to said first portion and in mirror image relationship with the second portion of said other wheel frame for corresponding aligned relationship of the horizontally extending passageways of said pair of wheel frames.

5. The hand cart as defined in claim 4 wherein each wheel frame includes a hollow interior with intersecting integral fins for structural rigidity.

6. The hand cart as defined in claim 5 wherein each upwardly extending male post contains peripherally spaced upstanding ribs for deformable and interfering engagement with the corresponding associated bottom opening in said drum.

7. The hand cart as defined in claim 1 wherein said upright handle sections include a generally vertically directed flange that is positioned to fit between the drum and a depending overhanging lip of an associated drum and drum cover at an upper end of the drum.

8. The hand cart as defined in claim 7 and further including a handle bracket complementary shaped relative to said drum and extending between said upright handle sections, said complementary shaped bracket receiving and mounting said upright handle sections with respect to each other and said interconnecting handle.

9. The hand cart as defined in claim 8 wherein said complementary shaped bracket is generally horizontally aligned and configured relative to the generally vertically directed flanges of said upright handle sections in order to trap the depending overhanging lip of said drum and drum cover therebetween.

10. The hand cart as defined in claim 9 wherein said interconnecting handle and said upright handle sections comprise interfitting tubular sections for telescopic association relative to one another, said handle bracket having corresponding openings for receiving one of said interconnecting handle, or upright handle tubular sections of said upright handle sections and interconnecting handle.

11. The hand cart as defined in claim 10 wherein said interconnecting handle comprises a one-piece tubular unit which extends both upwardly from said upright handle sections and outwardly away from said drum.

12. The hand cart as defined in claim 11 and further including a pair of caster wheels mounted to said drum in spaced relationship to one another about the periphery of said drum and on an opposite side of said drum from said wheeled hand cart.

13. The hand cart as defined in claim 12 and further including integral outwardly facing hook portions for engaging and mounting a removable container relative to said drum.

14. In a wet/dry utility vacuum cleaner having a hollow drum for collecting debris, the improvement comprising a wheeled hand cart mounted to said hollow drum for moving and re-positioning same, said wheeled hand cart including:

a pair of spaced wheel frames mounted to said drum about a lower outer periphery thereof, said wheel frames further each having a horizontally extending passageway and a vertically extending channel that intersects and extends across each horizontally extending passageway, said wheel frames being mounted to said drum to permit the horizontally extending passageways of each wheel frame to be in alignment with one another;

an upright handle section positioned within the vertically extending channel of each wheel frame and having a transverse opening therein for alignment with the horizontally extending passageway of each wheel frame, said upright handle sections being interconnected to one another;

a wheel axle extending through the horizontally extending passageways of both caster wheel frames including through the transverse openings in said upright handle sections; and wheels mounted on opposite ends of said wheel axle for wheeled movement of said hand cart.

15. The improvement as defined in claim 14 and further including a handle bracket complementary shaped relative to said drum which extends between said upright handle sections, and an interconnecting handle extending through openings provided in said handle bracket and being telescopically associated relative to upright handle sections.

16. The improvement as defined in claim 15 wherein said upright handle sections each have a generally vertically extending flange which is generally horizontally aligned relative to complementary shaped handle bracket and suitably dimensioned to engage the drum adjacent an overhanging depending lip of a drum and associated drum cover which overlies an upper end of said drum, while the overhanging depending lip of the drum cover is trapped between each generally vertically extending flange and handle bracket.

17. The improvement as defined in claim 16 wherein said wheel frames, when attached to said drum, include a first radially inwardly extending portion containing said wheel and a second portion angularly offset from said first portion and generally in mirror image relationship with the second portion of said other wheel frame, said second portion of said wheel frames containing said horizontal extending passageway and intersecting vertically extending channel.

* * * * *